US006289620B1

(12) United States Patent
Doria

(10) Patent No.: US 6,289,620 B1
(45) Date of Patent: Sep. 18, 2001

(54) SMOOTH BORE RIFLE BARREL

(75) Inventor: Pierluigi Doria, Moniga del Garda (IT)

(73) Assignee: S.p.A. Fabbrica Bresciana Armi, Brescia (IT)

( * ) Notice: Subject to any disclaimer, the term of this patent is extended or adjusted under 35 U.S.C. 154(b) by 0 days.

(21) Appl. No.: 09/306,159

(22) Filed: May 6, 1999

(30) Foreign Application Priority Data

Sep. 21, 1998 (IT) ..... MI98A2036

(51) Int. Cl.[7] ..... F41A 21/16
(52) U.S. Cl. ..... 42/79; 42/76.01
(58) Field of Search ..... 42/76.01, 79; 89/14.05

(56) References Cited

U.S. PATENT DOCUMENTS

| | | | | |
|---|---|---|---|---|
| 1,944,883 | * | 1/1934 | Gerlich | 89/14.05 |
| 2,465,962 | * | 3/1949 | Allen et al. | 89/14.05 |
| 2,828,569 | * | 4/1958 | Steane | 42/78 |
| 4,058,925 | * | 11/1977 | Linde et al. | 42/79 |

FOREIGN PATENT DOCUMENTS

| | | | | |
|---|---|---|---|---|
| 61107 | * | 3/1939 | (DK) | 89/14.05 |
| 800052 | * | 6/1936 | (FR) | 42/76.01 |
| 854516 | * | 11/1960 | (GB) | 42/76.01 |
| 374653 | * | 1/1940 | (IT) | 42/76.01 |
| 6101993 | * | 4/1994 | (JP) | 42/76.01 |

* cited by examiner

*Primary Examiner*—Stephen M. Johnson
(74) *Attorney, Agent, or Firm*—Hedman & Costigan, P.C.

(57) ABSTRACT

A smooth bore rifle barrel (10) comprising an initial portion or cartridge chamber (11), an intermediate portion or bore (12), a final portion, composed of a muzzle section (15, 16) and a terminal portion (13, 14) with a fixed choke or built in a manner to provide a series of interchangeable chokes. The muzzle section (15, 16) is provided with a conical fitting (15) connected to a portion (16) of the barrel (10) of a cylindrical shape, so as to attain, at a predetermined ratio between the lengths and diameters of the conical fitting (15) and of the cylindrical portion (16), a reduction of the recoiling force with respect to that of known rifle barrels, without changing the exit velocity and spreading angle of the gunshot.

5 Claims, 1 Drawing Sheet

SMOOTH BORE RIFLE BARREL

This invention refers to a smooth bore rifle barrel. The internal geometry of smooth bore rifle barrels is generally common to any rifle type or model, based also on the fact that there are specific international standards defining the shape, proportions and measurements to be provided, depending on the various sizes of a barrel.

In particular, very narrow tolerances are provided in the initial portion of the barrel or cartridge chamber, while a relatively broader excursion of sizes is allowed in the intermediate or bore area and in the muzzle area. Tradition, experience and cartridge loading systems have dictated the adoption, on the part of practically the entirety of arms producers, of a bore diameter for smooth bore rifles of a caliber 12, equal to 18, 4 mm.

In this regard, it should be mentioned at the outset that the values of the dimensions of various portions of a rifle barrel mentioned in this application are meant to refer to a rifle of caliber 12, however, the principle of this invention equally applies to rifles of caliber 20, considering the appropriate corrections in the absolute values of measurement.

It is obvious, however, that in terms of the ratio between the various parameters, the values mentioned in this application apply both to rifles of caliber 12 as well as 20.

The 18.4 mm diameter size of a caliber 12 rifle barrel bore allows an excellent ballistic performance, considering the relationship existing between cartridge pressure, shot exit speed and recoiling force on the user's shoulder.

The relevant international standards allow adopting as a bore diameter value any figure within a range of 18.2 to 18.9 mm.

The onset of ever lighter rifles and the use of heavy charges, combined with the prolonged rifle usage as occurring in sports events makes it necessary to reduce the recoiling force, so as to soften the strain on the user and make it less troublesome.

This condition is particularly important in competitive events, where the shooting stress and trouble could affect results.

By adopting an internal rifle bore diameter within the allowable upper limits, meaning between about 18.8 and 18.9 mm, the recoil is reduced as a result of lower gas compression; however, such a diameter size results in a loss of gunshot charge exit speed.

For this reason, a diameter value close to the lower limit, meaning 18.4 mm, has always conveniently been used in order to prevent a loss of efficiency in terms of the useful arresting power or traveling distance of the gunshot, and therefore of the barrel's shooting reach.

The terminal portion of a traditional barrel provides for a restriction to reduce the exit diameter of the barrel for the gunshot, depending on the desired width of the spreading angle.

The restrictions may be built into the barrels themselves (fixed restriction barrels) or they may be achieved by interchangeable chokes, applicable on a universal barrel size fitted with an appropriate seat in the muzzle area.

The starting diameter of the interchangeable chokes is directly dependent on the bore diameter; for a weapon with a bore diameter of 18, 4 mm, for example, the choke diameter equals 18.5 mm, so as to ensure a continuity inside the barrel, without introducing dangerous irregularities.

The foregoing description makes it evident that it would be desirable to produce barrels having a bore equal to the maximum allowable size, meaning of 18.8–18.9 mm, so as to achieve a softer recoiling action on the user's shoulders; on the other hand, however, this would result in a loss of the projectile's exit velocity and in the use of variable chokes, with respect to the traditional types for barrels with interchangeable chokes, of different inlet diameter and thickness.

This solution would therefore generate additional drawbacks, owing to the loss of interchangeability wit the traditional chokes.

Moreover, due to the greater thickness of the barrels, the reduced convergence between the two barrels of a superposed rifle ("double barrel rifle") would cause some shot centering errors, in the sense that the first and the second shot would hardly be able to hit the target in the same manner.

The purpose of this invention is therefore to offer a smooth bore rifle barrel capable of eliminating the mentioned drawbacks, or to indicate a rifle barrel capable of achieving a reduced recoiling force with respect to that occurring with the use of traditional barrels, while at the same time ensuring a practically unchanged shot exit velocity.

Another purpose of this invention is to produce a smooth bore rifle barrel capable of allowing the usage of a single family of interchangeable chokes, both on traditional and on enlarged rifle barrels.

A further purpose of this invention is to produce a smooth barrel bore whose internal thickness would keep the convergence of the rifles' double-barrels unchanged with respect to that of traditional barrels, thus achieving a favorable shooting precision.

Not the last purpose of the invention is to build a smooth bore rifle barrel in an essentially simple and inexpensive manner, without affecting the dimensions of encumbrance, the esthetic appearance and elegance of traditional rifles.

These purposes are attained by a smooth bore rifle barrel according to claim 1, which is being referred to for brevity.

In an advantageous manner, the particular geometry of a rifle portion known as "the muzzle", meaning the area just before the final choke, as well as the lengths of the conical and cylindrical portions present inside a barrel allow achieving an optimum regularity of the internal ballistic phenomenon and of the exit velocity and distribution of the gunshot.

Further purposes and advantages of this invention will become evident from the following description and attached drawings, supplied for purely exemplifying and non-limiting purposes, in which.

Figure 1:
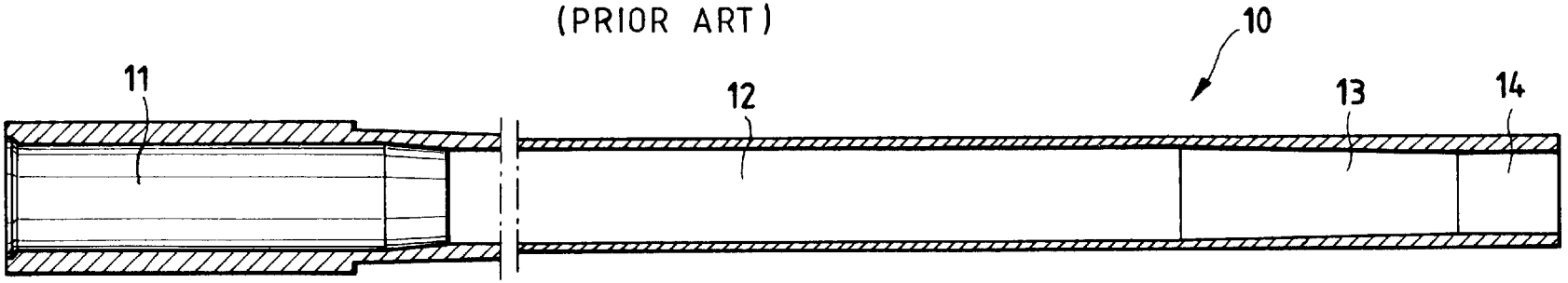
Fig.1 (PRIOR ART)
FIG. 1 shows a longitudinal section of a portion of a smooth bore rifle barrel, produced according to the known state of the art.
Figure 2:
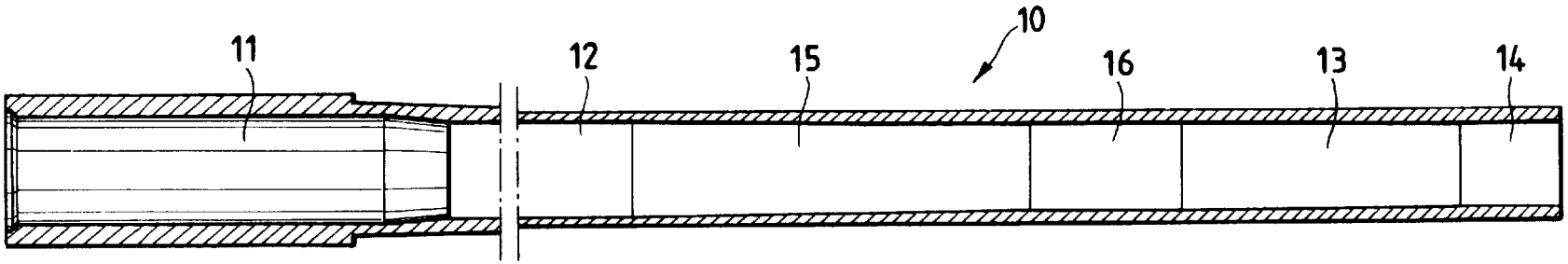
FIG. 2 shows a longitudinal section of a portion of a smooth bore rifle barrel, produced according to this invention.

With reference to the mentioned figures, 10 generally indicates a smooth bore rifle barrel.

The barrel 10 exhibits an extremity composed of a cartridge chamber 11, and a free opposite extremity.

A portion 12 of the barrel bore 10, connected to the cartridge chamber 11, is essentially cylindrical and shows an internal diameter in the range of for example 18.8–18.9 millimeters (caliber 12 rifles).

At the extremity of the bore 12 facing the cartridge chamber 11, the barrel 10 presents a muzzle zone. The muzzle zone of the barrel 10 comprises a first portion 15 of an essentially truncated conical shape, and a second portion 16 of an essentially cylindrical shape.

The truncated conical portion 15 is interposed between the cylindrical portion 12 and the cylindrical portion 16, which presents a smaller diameter than that of the cylindrical portion 12 itself.

The portion 16 of the barrel 10 has a diameter for example in the range of 18.3 to 18.5 millimeters (caliber 12 rifles), while the overall length of the portion 15 and 16 of the barrel 10 is in any case larger than 80.0 millimeters. The overall length of the portions 15 and 16 is preferably equal to 100.0 millimeters.

The cylindrical portion 16 is connected to a final choke formed by the portions 13, 14 of the barrel 10.

The portion 13 is essentially conical and connected to the portion 14, which is essentially cylindrical, of a variable diameter and depending on the value of the restriction desired for the barrel 10.

For caliber 12 rifles the diameter of the portion 14 of the final choke is within the range of 16.9 and 18.4 millimeters.

A different construction of the barrel 10 carries at the extremity of its portion 16 a seat to house interchangeable final chokes. It is evident that such a construction of the barrel 10 is entirely similar to that already outlined above, and therefore no longer described below.

The operation of a barrel 10 for smooth bore rifles according to the invention is essentially as follows.

At the instant of shooting, the gases generated by the combustion of a charge expand within the bore 12 of the barrel 10. This bore 12, having essentially a high diameter, determines a considerably softer recoil.

In the conical length 15 of the muzzle, the velocity of the gases speeds up, thus also increasing the velocity of the gunshot carried along by the gas.

The gunshot is therefore aligned in the essentially cylindrical stretch 16 of the muzzle zone of the barrel 10, which exhibits a diameter equal to about 18.3 to 18.5 millimeters.

The portions 13 and 14 constitute a final restriction of the barrel 10 while causing a further increase of gunshot velocity and a change in the width of its spreading angle, proportional to the value of the final restriction itself.

After passing the stretches 12, 15 and 16 resulting in a reduced recoil, the column of gunshot, owing to this geometry (Venturi tube) attains an increased velocity so as to compensate for the former loss. In the final restriction 13 (achieved both on barrels with a fixed restriction or on barrels with interchangeable chokes), the gunshot then acquires the further velocity and spreading angle width corresponding to the traditional restriction values governed by international standards.

The shooting performances achieved with a rifle mounting a barrel according to the invention are essentially similar to those of a rifle mounting a traditional barrel.

In addition, according to the invention, the particular geometry of the barrel 10, and in particular the geometry of the muzzle zones 15 and 16 as well as the dimensions and in particular the length of the conical portions 15 and of the cylindrical portions 15 are of decisive importance for the regularity of the internal ballistic phenomenon, both from the viewpoint of gunshot distribution as of reduced recoiling force, so as to soften the shooting strain.

The above description clearly outlines the characteristics as well as the advantages of the smooth bore rifle barrel object of this invention.

It is in any case evident that many variants can be applied to the barrel which is the subject of the present invention, without departing from the principles of novelty inherent in the inventive concept. It is also apparent that in practical implementation of the invention, any materials, shapes and dimensions can be used for the details illustrated, according to requirements, and these can be replaced by others which are technically equivalent.

What is claimed is:

1. A gunshot propelling smooth bore rifle barrel comprising at least one first portion of essentially cylindrical bore, associated with a cartridge chamber for gunshot, where said barrel exhibits at its free extremity a choke composed of at least one second essentially truncated conical portion associated with a third portion of the extremity of an essentially cylindrical shape and of a diameter essentially smaller than that of said first cylindrical portion, wherein said smooth bore rifle barrel comprises, in a position intermediate between said first cylindrical portion and said second truncated conical portion, at least one fourth essentially truncated conical portion associated on one side with said first cylindrical portion and on the other side with a fifth essentially cylindrical portion exhibiting a diameter essentially smaller than that of said first cylindrical portion and being further connected to said truncated conical portion, wherein said fourth truncated conical portion and said fifth cylindrical portion of said barrel exhibit an overall length exceeding 80 millimeters.

2. A gunshot propelling smooth bore rifle barrel according to claim 1, wherein said first portion of said barrel has a diameter in the range of 18.3 to 19.0 millimeters.

3. A gunshot propelling smooth bore rifle barrel according to claim 1, wherein said fifth portion of said barrel has a diameter in the range of 18.0 to 18.8 millimeters.

4. A gunshot propelling smooth bore rifle barrel according to claim 1, wherein said first portion of said barrel has a diameter in the range of 18.8 and 18.9 millimeters.

5. A gunshot propelling smooth bore rifle barrel according to claim 1, wherein said fifth portion of said barrel has a diameter in the range of 18.3 to 18.5 millimeters.

* * * * *